US011254496B2

(12) United States Patent
Wang et al.

(10) Patent No.: US 11,254,496 B2
(45) Date of Patent: Feb. 22, 2022

(54) GARBAGE-CAN-TYPE DUST COLLECTOR

(71) Applicant: Yongkang Sippon Electric Co., Ltd., Zhejiang (CN)

(72) Inventors: Yongping Wang, Zhejiang (CN); Linmin Wang, Zhejiang (CN)

(73) Assignee: YONGKANG SIPPON ELECTRIC CO., LTD., Zhejiang (CN)

( * ) Notice: Subject to any disclaimer, the term of this patent is extended or adjusted under 35 U.S.C. 154(b) by 57 days.

(21) Appl. No.: 16/831,205

(22) Filed: Mar. 26, 2020

(65) Prior Publication Data

US 2020/0339344 A1 Oct. 29, 2020

(30) Foreign Application Priority Data

Apr. 26, 2019 (CN) ..... 201910345054.4

(51) Int. Cl.
*B65F 1/14* (2006.01)
*B65F 1/06* (2006.01)

(52) U.S. Cl.
CPC ..... *B65F 1/1426* (2013.01); *B65F 1/06* (2013.01); *B65F 2210/137* (2013.01); *B65F 2210/1795* (2013.01)

(58) Field of Classification Search
CPC .... B65F 1/06; B65F 1/1426; B65F 2210/137; B65F 2210/1795; B65F 2210/136; B65F 2210/179; B65F 2210/188
USPC ..... 220/495.06, 495.04, 745
See application file for complete search history.

(56) References Cited

FOREIGN PATENT DOCUMENTS

WO WO2017219932 * 12/2017 ..... B65F 1/06

* cited by examiner

*Primary Examiner* — Don M Anderson
*Assistant Examiner* — Elizabeth J Volz
(74) *Attorney, Agent, or Firm* — Muncy, Geissler, Olds & Lowe, P.C.

(57) ABSTRACT

A garbage-can-type dust collecto includes a housing assembly, an inner barrel body for mounting or fixing a garbage bag, and a draught fan for driving airflow movement such that dust enters the garbage bag. The inner barrel body is detachably mounted on the housing assembly, the inner barrel body is provided with an accommodating chamber, and the garbage bag arranged in the accommodating chamber divides the accommodating chamber into an upper chamber and a lower chamber. The gas extraction hole is communicated to the wind chamber and the upper chamber, the inner barrel body is provided with a gas suction port for extracting air in the lower chamber when the draught fan is in operation, and the gas suction port communicates the wind chamber to the lower chamber. The present disclosure has the beneficial effect of effectively preventing a garbage bag from blowing up.

9 Claims, 8 Drawing Sheets

GARBAGE-CAN-TYPE DUST COLLECTOR

CROSS-REFERENCE TO RELATED APPLICATIONS

This Non-provisional application claims priority under 35 U.S.C. § 119(a) on Patent Application No(s). 201910345054.4 filed in Republic of China on 26 Apr. 2019, the entire contents of which are hereby incorporated by reference.

BACKGROUND OF THE INVENTION

Field of the Invention

The present disclosure relates to a garbage-can-type dust collector.

Description of the Related Art

Dust collectors are machines generating negative air pressure by using draught fans in housings to collect dust. As household appliances, garbage-can-type dust collectors integrate garbage-can functions and dust collector functions, and can directly collect garbages into garbage bags in garbage cans.

When conventional garbage-can-type dust collectors are in operation, a negative pressure generated by the draught fans directly acts on the space inside the garbage bags, which probably blows the garbage bags up, and thus having a negative effect on use experiences of users.

BRIEF SUMMARY OF THE INVENTION

To solve shortcomings of the existing technologies, the present disclosure provides a garbage-can-type dust collector, which can prevent a garbage bag from blowing up by means of structural adjustment of an inner barrel body and optimization of a wind path.

To achieve the above objective, the present disclosure adopts the following technical solutions. A garbage-can-type dust collector includes: a housing assembly, an inner barrel body for mounting or fixing a garbage bag, and a draught fan for driving airflow movement such that dust enters the garbage bag. The inner barrel body is detachably mounted on the housing assembly. The inner barrel body is provided with an accommodating chamber. The garbage bag arranged in the accommodating chamber divides the accommodating chamber into an upper chamber and a lower chamber.

The housing assembly and/or the inner barrel body is provided with a dust collection inlet allowing the dust to enter the garbage bag in the inner barrel body, an gas extraction hole for extracting gas in the garbage bag to form a negative pressure forcing the dust to be collected from the dust collection inlet into the garbage bag, and a wind chamber where gas is extracted by the draught fan to generate the negative pressure when the draught fan is in operation. The gas extraction hole is communicated to the wind chamber and the upper chamber. The inner barrel body is provided with a gas suction port for extracting air in the lower chamber when the draught fan is in operation, and the gas suction port communicates the wind chamber to the lower chamber.

Further, the gas suction port is arranged at a bottom of the inner barrel body.

Further, the gas suction port is arranged right above the draught fan.

Further, the garbage-can-type dust collector further includes a seal-capping for sealing off the gas suction port, and the seal-capping is mounted on the inner barrel body.

Further, the inner barrel body includes an upper barrel hoop and a lower barrel body. The upper barrel hoop is detachably connected to the lower barrel body, the upper barrel hoop and the lower barrel body clamp the garbage bag, and the lower barrel body is provided with the gas suction port.

Further, the garbage-can-type dust collector further includes a handle allowing a user to grip to separate the inner barrel body from the housing assembly, and the handle is connected to the upper barrel hoop.

Further, the housing assembly includes a housing provided with a barrel chamber for accommodating the inner barrel body, a top cap for closing the barrel chamber, and a pipe mounting element for mounting a dust collection pipe. The top cap is movably connected to the housing, the pipe mounting element is fixed to the housing, and the pipe mounting element is provided with a dust collection nozzle allowing gas to enter. The upper barrel hoop is provided with a dust collection inlet, and the dust collection inlet is communicated to the dust collection nozzle. A side of the upper barrel hoop far away from the dust collection inlet is provided with a first guide diagonal rib for working in coordination with the housing assembly to limit a position of the inner barrel body with respect to the housing assembly such that an outer wall surface of the dust collection inlet fits into the pipe mounting element to provide good sealing.

Further, the housing assembly also includes a dust collection nozzle cap for closing the dust collection nozzle and a reset spring for resetting the dust collection nozzle cap. The dust collection nozzle cap is rotatably connected to the pipe mounting element.

Further, the housing includes: a side housing surrounding the inner barrel body and a bottom base for supporting the inner barrel body. The draught fan is mounted on the bottom base, the bottom base is provided with an exhaust port communicating to the wind chamber to allow gas to discharge and a gas inlet communicating to the wind chamber, and the gas inlet is aligned to the gas suction port.

Further, the upper barrel hoop is provided with the gas extraction hole, the housing assembly includes a gas extraction pipe communicating the gas extraction hole to the wind chamber and a pipe joint for connecting the gas extraction pipe to the upper barrel hoop such that gas enters the wind chamber through the extraction pipe via the gas extraction hole, and the pipe joint is mounted at one end of the gas extraction pipe. A side of the upper barrel hoop far away from the pipe joint is provided with a second guide diagonal rib for working in coordination with the housing assembly to limit a position of the inner barrel body with respect to the housing assembly such that the upper barrel hoop fits into the pipe joint to provide good sealing.

The present disclosure has following beneficial effects.

Vacuumization by air pressure generated by the draught fan can force the garbage bag to be adsorbed on the barrel wall, which effectively prevents the garbage bag from blowing up.

Meanwhile, no additional fixing structure is needed to allow the garbage bag to fit onto the barrel wall so as to prevent the garbage bag from blowing up.

The gas suction port is closed by the seal-capping, and garbages can be directly loaded into the inner barrel body when the garbage bag is insufficient.

The upper barrel hoop and the lower barrel body clamp the garbage bag conveniently and quickly.

DETAILED DESCRIPTION OF THE INVENTION

The present disclosure is introduced in detail below with reference to the accompanying drawings and specific embodiments.

Figure 1:
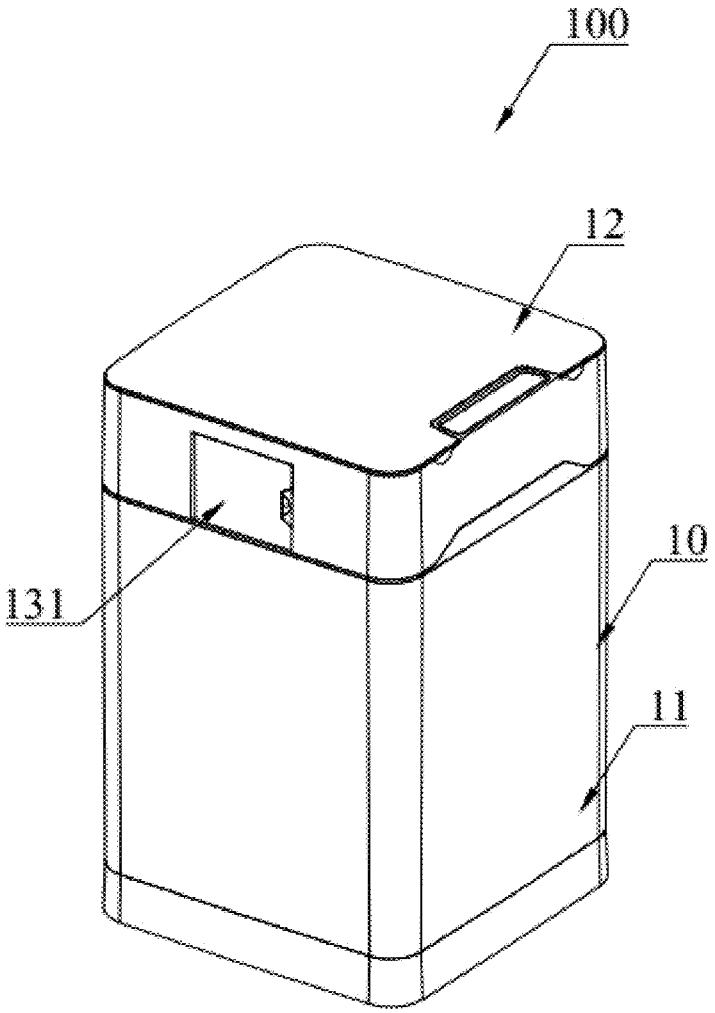
FIG. 1 is a schematic diagram of a garbage-can-type dust collector.
Figure 2:
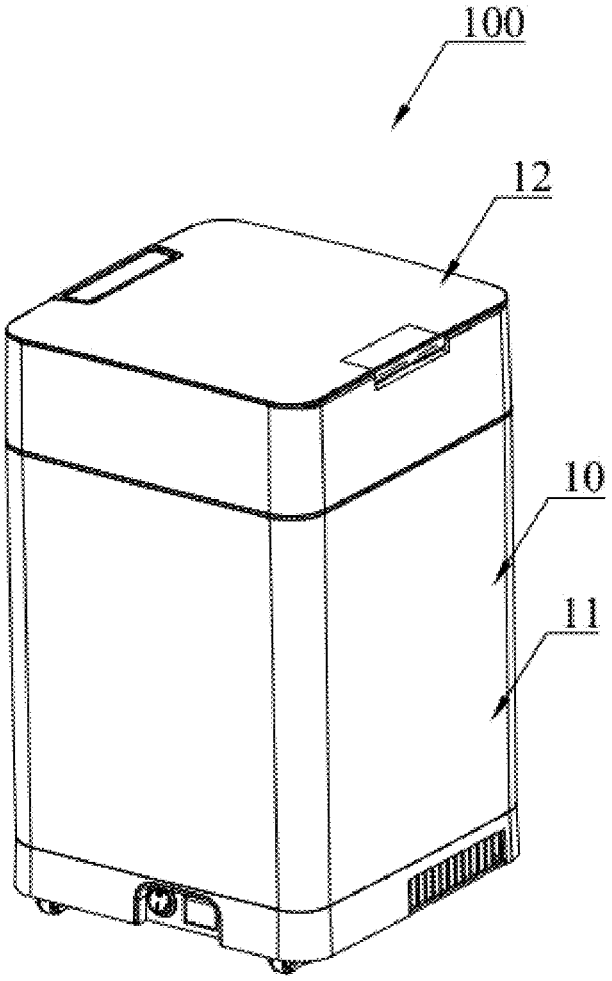
FIG. 2 is a schematic diagram of the garbage-can-type dust collector in FIG. 1 from another viewing angle.
Figure 3:
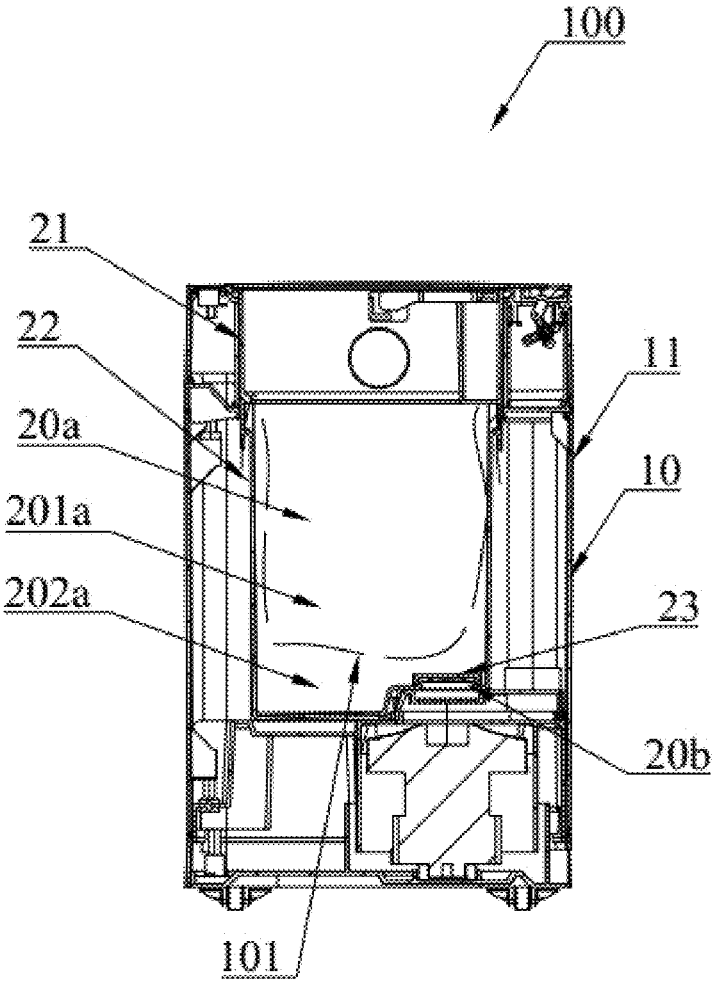
FIG. 3 is a cross-sectional view of the garbage-can-type dust collector in FIG. 1.
Figure 4:
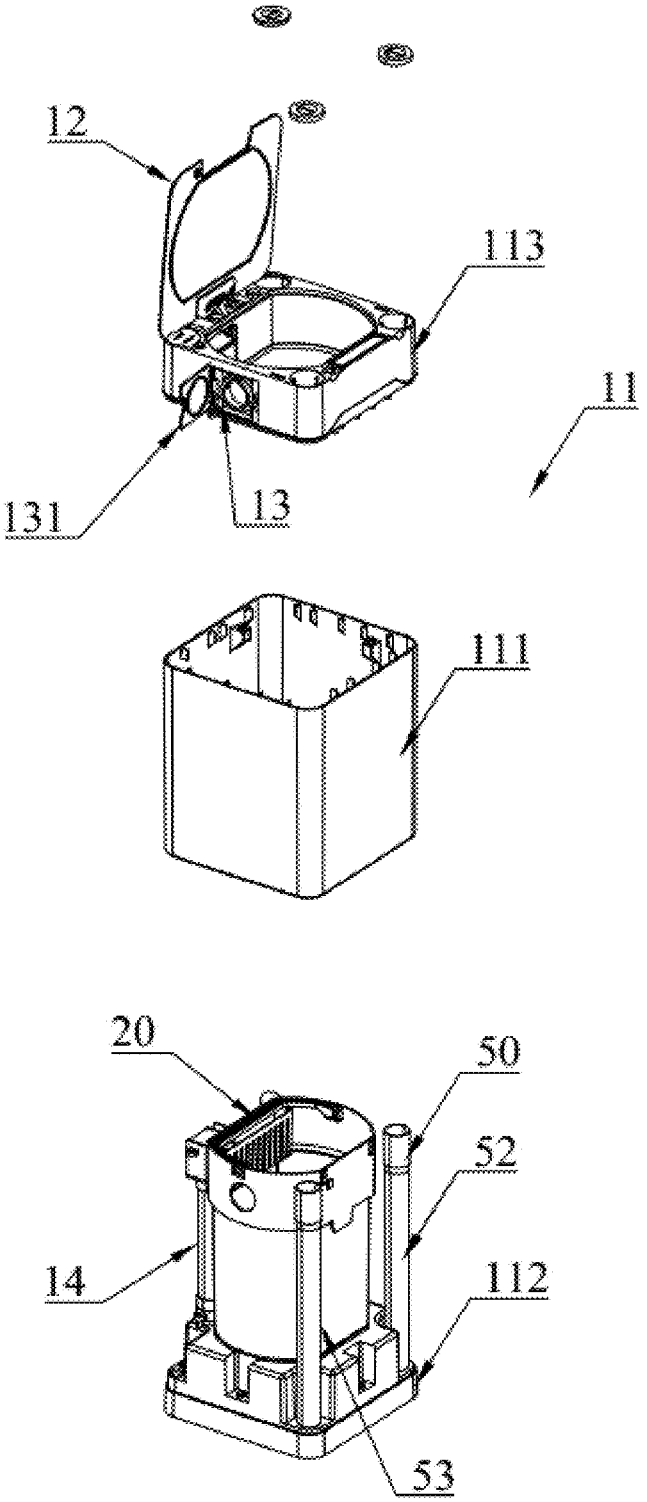
FIG. 4 is an exploded view of the garbage-can-type dust collector in FIG. 1.
Figure 5:
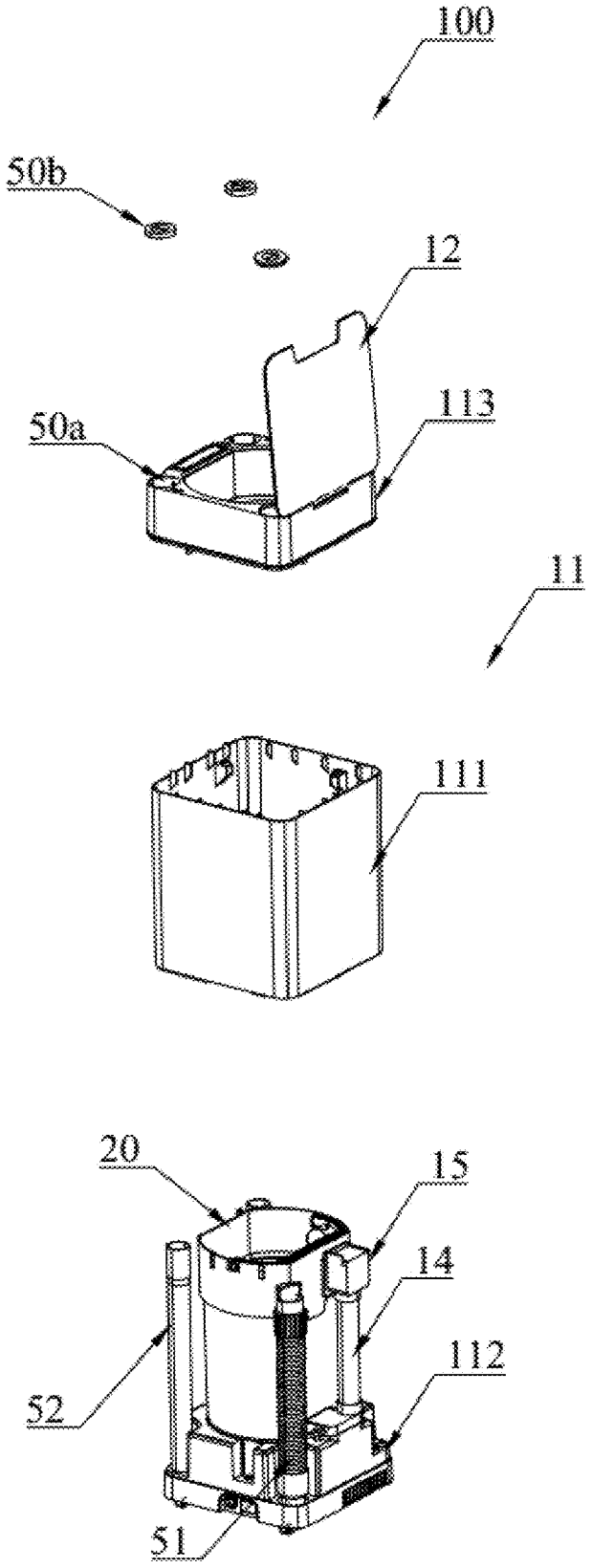
FIG. 5 is an exploded view of the garbage-can-type dust collector in FIG. 1 from another viewing angle.
Figure 6:
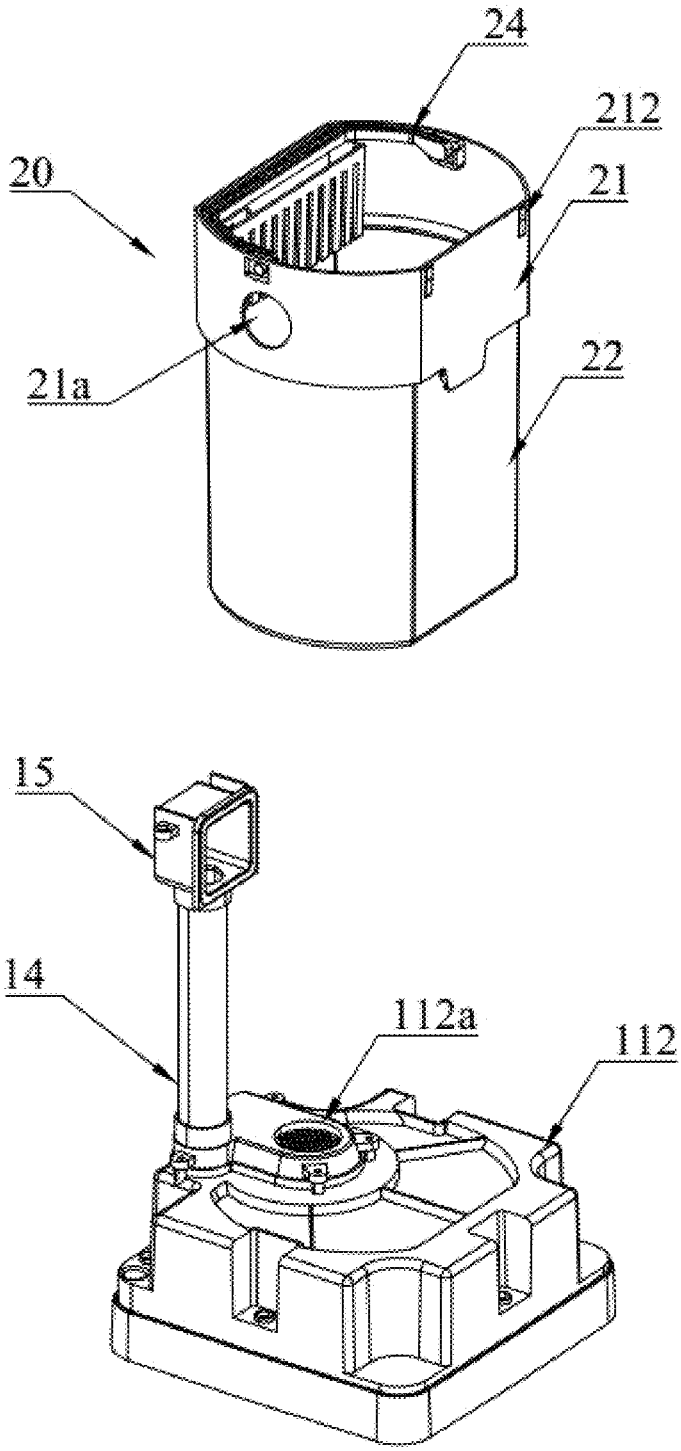
FIG. 6 is a schematic diagram of a bottom base and an inner barrel body of the garbage-can-type dust collector in FIG. 1.
Figure 7:
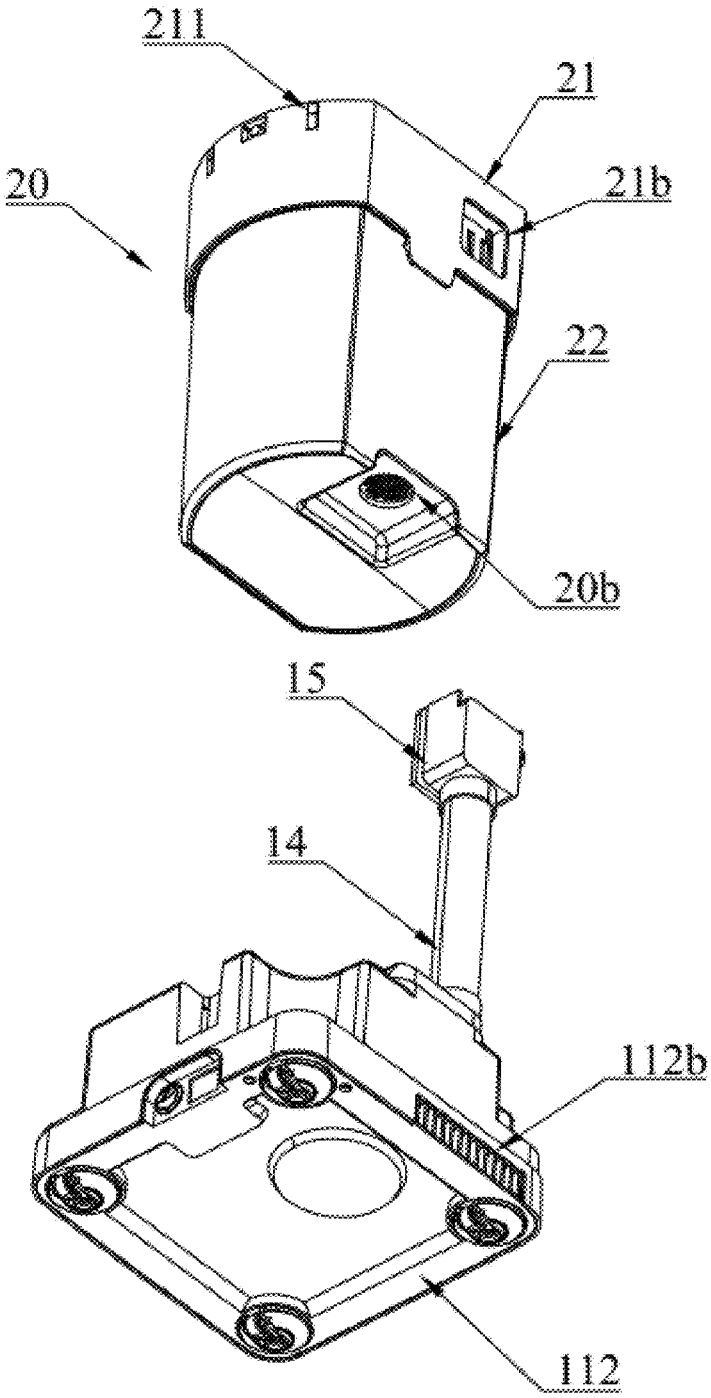
FIG. 7 is a schematic diagram of the structure in FIG. 6 from another viewing angle.
Figure 8:
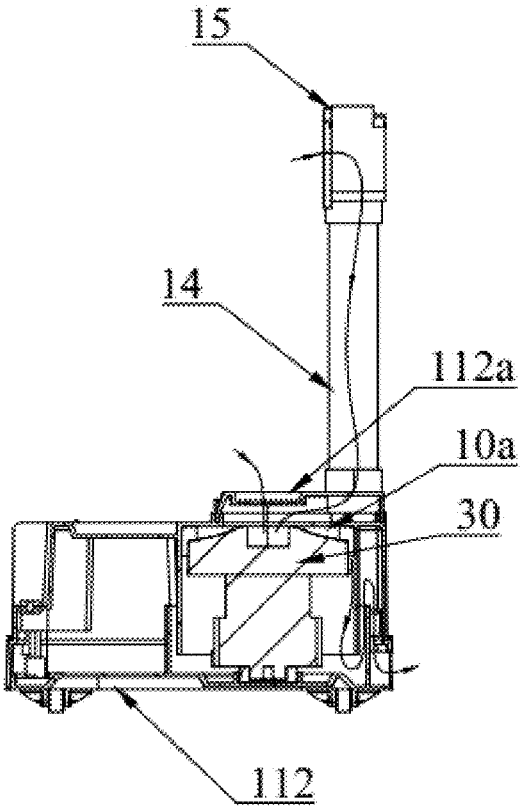
FIG. 8 is a schematic diagram of an airflow movement path of the garbage-can-type dust collector in FIG. 1, wherein arrows and lines show the airflow movement path. Garbage-can-type dust collector 100, housing assembly 10, wind chamber 10*a*, housing 11, side housing 111, bottom base 112, exhaust port 112*a*, gas inlet 112*b*, upper base 113, top cap 12, pipe mounting element 13, dust collection nozzle cap 131, gas extraction pipe 14, pipe joint 15, inner barrel body 20, accommodating chamber 20*a*, upper chamber 201*a*, lower chamber 202*a*, gas suction port 20*b*, upper barrel hoop 21, dust collection inlet 21*a*, gas extraction hole 21*b*, first guide diagonal rib 211, second guide diagonal rib 212, lower barrel body 22, seal-capping 23, handle 24, draught fan 30, garbage bag 101, dust collection pipe group 50, dust collection pipe 51, dust collection pipe 52, dust collection pipe 53, pipe hole 50*a*, and pipe hole cap 50*b*.

As shown in FIG. 1 to FIG. 8, a garbage-can-type dust collector 100 includes a housing assembly 10, an inner barrel body 20, and a draught fan 30.

The inner barrel body 20 is used for mounting or fixing a garbage bag 101. As a preferred embodiment, the inner barrel body 20 includes: an upper barrel hoop 21 21 and a lower barrel body 22. The upper barrel hoop 21 is detachably connected to the lower barrel body 22. Specifically, the upper barrel hoop 21 and the lower barrel body 22 are connected by a snap buckle structure, making them convenient to be disassembled and assembled. The upper barrel hoop 21 and the lower barrel body 22 clamp the garbage bag 101. The inner barrel body 20 is detachably mounted on the housing assembly 10. To facilitate a user to separate the inner barrel body 20 from the housing assembly 10, the garbage-can-type dust collector 100 is provided with a handle 24. Specifically, the handle 24 is connected to the upper barrel hoop 21. Further, the handle 24 is rotatably connected to the upper barrel hoop 21. When it is needed to use the handle 24, the handle 24 is rotated until the handle 24 is erected and enters into an operating state. When it is not needed to use the handle 24, the handle 24 may be rotated until the handle 24 enters into a non-operating state.

The draught fan 30 is used for driving airflow movement such that dust enters the garbage bag 101. The draught fan 30 includes a fan and a motor. The motor drives the fan to rotate. As a specific embodiment, the draught fan 30 is powered by alternating current. As an alternative embodiment, the draught fan 30 is powered by direct current. Specifically, the garbage-can-type dust collector further includes a lithium battery for supplying power to the draught fan. The lithium battery is mounted in the housing assembly. As another alternative embodiment, the garbage-can-type dust collector may not be provided with the lithium battery, and the draught fan is powered by an external lithium battery. The inner barrel body 20 is provided with an accommodating chamber 20*a*.

The garbage bag 101 in the inner barrel body 20 divides the accommodating chamber 20*a* into an upper chamber 201*a* and a lower chamber 202*a*.

The upper chamber 201*a* serves as space of the garbage bag 101 for loading garbages. The lower chamber 202*a* serves as space between the bottom of the garbage bag 101 and the accommodating chamber 20*a*. When the garbage bag 101 fits onto the chamber wall of the accommodating chamber 20*a*, the volume of the lower chamber 202*a* will be reduced to a minimum value, and the volume may be zero. A conventional garbage-can-type dust collector blowing up behaves in a manner that the garbage bag blows up by a negative pressure, and the volume of the upper chamber is reduced so much that the normal function of loading garbages cannot be completed.

As a specific embodiment, the inner barrel body 20 is provided with a dust collection inlet 21*a*. The dust collection inlet 21*a* allows dust to enter the garbage bag 101 in the inner barrel body 20. The inner barrel body 20 is provided with an gas extraction hole 21*b*. The gas extraction hole 21*b* extracts the gas in the garbage bag 101 to form a negative pressure forcing the dust to be collected from the dust collection inlet 21*a* into the garbage bag 101. The housing assembly 10 is provided with a wind chamber 10*a*. Gas is extracted when the draught fan 30 is in operation to generate the negative pressure in the wind chamber 10*a*. The gas extraction hole 21*b* is communicated to the wind chamber 10*a* and the upper chamber 201*a*. When the draught fan 30 is in operation, the gas in the upper chamber 201*a* is extracted to generate a negative pressure in the upper chamber 201*a*, such that garbages can be collected into the upper chamber 201*a*, i.e., space in the garbage bag for loading garbages. In order to prevent impurities such as dust from being collected into the wind chamber 10*a* when the garbage-can-type dust collector 100 is in operation, a filtering device is arranged at the gas extraction hole 21*b* to filter air. As a specific embodiment, the filtering device is filter paper or a filter screen.

The housing assembly and/or the inner barrel body is provided with a dust collection inlet, a gas extraction hole, and a wind chamber. The dust collection inlet may be formed by the housing assembly or the inner barrel body, or may be jointly formed by the housing assembly and the inner barrel body as a whole. Similarly, the gas extraction hole may be formed by the housing assembly or the inner barrel body, or may be jointly formed by the housing assembly and the inner barrel body as a whole. The wind chamber may be formed by the housing assembly or the inner barrel body, or may be jointly formed by the housing assembly and the inner barrel body as a whole.

For a conventional garbage-can-type dust collector, the garbage bag may be sucked up or blown up by the negative pressure generated in the garbage bag when the draught fan is in operation, which may reduce the space of the upper chamber, making it inconvenient for the garbage bag to load garbages.

The inner barrel body 20 is provided with a gas suction port 20*b*. The gas suction port 20*b* communicates the wind chamber 10*a* to the lower chamber 202*a*. When the draught fan 30 is in operation, air in the lower chamber 202*a* is extracted from the gas suction port 20*b*. There is only one gas suction port 20*b* between the lower chamber 202*a* and the outside. After the air is extracted via the gas suction port 20*b*, the air in the lower chamber 202*a* decreases and the negative pressure gradually increases, such that a downward pulling force is applied to the garbage bag, forcing the garbage bag to directly fit onto the chamber wall of the accommodating chamber 20*a*. That is, no additional fixing structure is needed to force the garbage bag to fit onto the barrel wall. When the garbage bag fits onto the chamber wall of the accommodating chamber 20*a*, that is, when the negative pressure reaches a certain level, the air in the lower chamber 202*a* cannot be continuously extracted via the gas suction port 20*b*. At this moment, the suction force generated by the draught fan 30 is totally allocated to the gas extraction hole 21*b*, so as to ensure that a stable suction force is provided for the dust collection in the normal working process.

As a preferred embodiment, the gas suction port 20*b* is arranged at the bottom of the inner barrel body 20. Specifically, the gas suction port 20*b* is arranged right above the draught fan 30. This helps to quickly complete the extraction of the air in the lower chamber 202*a*.

As a preferred embodiment, the garbage-can-type dust collector 100 further includes a seal-capping 23 for sealing off the gas suction port 20*b*.

The seal-capping 23 is mounted on the inner barrel body 20. When the garbage bag is not arranged, the seal-capping 23 may be used to seal off the gas suction port 20*b*, and the accommodating chamber 20*a* of the inner barrel body 20 is used to load garbages.

As a specific embodiment, the housing assembly 10 includes a housing 11, a top cap 12, and a pipe mounting member 13 for mounting the dust collection pipe 51.

The housing 11 is provided with a barrel chamber that accommodates the inner barrel body 20. The top cap 12 is used for sealing off the barrel chamber. The top cap 12 is movably connected to the housing 11. After the top cap 12 is opened, the inner barrel body 20 may be taken out of the barrel chamber. As a specific embodiment, a separate openable motor is arranged to drive the top cap 12 to implement the cap opening or closing operation. The housing assembly 10 includes an upper base 113. Specifically, the housing 11 includes the upper base 113. The top cap 12 is movably connected to the upper base 113. The openable motor drives the top cap 12 to move with respect to the upper base 113 to open or close the top cap 12.

The pipe mounting element 13 is used for mounting the dust collection pipe 51. The pipe mounting element 13 is fixed to the housing 11. Specifically, the pipe mounting element 13 is fixed to the upper base 113. The pipe mounting element 13 is provided with a dust collection nozzle allowing the gas to enter. The upper barrel hoop 21 is provided with a dust collection inlet 21*a*. The dust collection inlet 21*a* is communicated with the dust collection nozzle.

A side of the upper barrel hoop 21 far away from the dust collection inlet 21*a* is provided with a first guide diagonal rib 211 for working in coordination with the housing assembly 10 to limit a position of the inner barrel body 20 with respect to the housing assembly 10 such that an outer wall surface of the dust collection inlet 21*a* fits into the pipe mounting element 13 to provide good sealing.

The housing assembly 10 further includes a dust collection nozzle cap 131 for closing the dust collection nozzle and a reset spring for resetting the dust collection nozzle cap 131. The dust collection nozzle cap 131 is movably connected to the pipe mounting element 13. Specifically, the dust collection nozzle cap 131 is rotatably connected to the pipe mounting element 13.

As a specific embodiment, the housing 11 includes a side housing 111 surrounding the inner barrel body and a bottom base 112 for supporting the inner barrel body. The side housing 111 connects the upper base 113 and the bottom base 112. The draught fan 30 is mounted on the bottom base 112. The bottom of the bottom base 112 is provided with a roller wheel to facilitate the movement of the garbage-can-type dust collector 100. The bottom base 112 is provided with a control switch for controlling the draught fan 30.

The bottom base 112 is provided with an exhaust port 112*a* communicating to the wind chamber 10*a* to allow gas to discharge and a gas inlet 112*b* communicating to the wind chamber 10*a*. The gas inlet 112*b* is aligned to the gas suction port 20*b*.

The upper barrel hoop 21 is provided with the gas extraction hole 21*b*. The housing assembly 10 includes a gas extraction pipe 14 communicating the gas extraction hole 21*b* to the wind chamber 10*a* and a pipe joint 15 for connecting the gas extraction pipe 14 to the upper barrel hoop 21 such that gas enters the wind chamber 10*a* through the gas extraction pipe 14 via the gas extraction hole 21*b*. The pipe joint 15 is mounted at one end of the gas extraction pipe 14.

A side of the upper barrel hoop 21 far away from the pipe joint 15 is provided with a second guide diagonal rib 212 for working in coordination with the housing assembly 10 to limit a position of the inner barrel body 20 with respect to the housing assembly 10 such that the upper barrel hoop 21 fits into the pipe joint 15 to provide good sealing.

As a preferred embodiment, the garbage-can-type dust collector 100 further includes a dust collection pipe group 50. The dust collection pipe group 50 can expand the dust collection range, and the user may hold the dust collection pipe group 50 to perform a dust collection on a designated area or location.

The housing assembly 10 is provided with a barrel chamber for accommodating the inner barrel body 20. The inner barrel body 20 is detachably mounted on the housing assembly 10. The dust collection pipe group 50 is detachably connected to the housing assembly 10. The dust collection pipe group 50 includes a plurality of dust collection pipes which can be connected to each other.

At least one of the plurality of dust collection pipes is a telescopic flexible pipe. The plurality of dust collection pipes are arranged on the periphery of the inner barrel body 20 and are located between the side housing 111 and the inner barrel body 20.

The garbage-can-type dust collector 100 has a storage function of the dust collection pipe group 50. Compared with a garbage-can-type dust collector 100 which cannot store the dust collection pipe group 50, the dust collection pipe group 50 is not easy to be lost and is convenient to use. When it is needed to use the dust collection pipe group 50, the dust collection pipe may be connected and inserted into the pipe mounting member 13.

The dust collection pipe is stored in space between the housing assembly 10 and the inner barrel body 20. The volume of the garbage-can-type dust collector 100 may be reduced by reasonably utilizing the space.

As a specific embodiment, the dust collection pipe group 50 includes a dust collection pipe 51, a dust collection pipe 52, and a dust collection pipe 53. The dust collection pipe 51 is a telescopic flexible pipe, and the dust collection pipe 52 and the dust collection pipe 53 are rigid pipes. As an alternative embodiment, all the three dust collection pipes may be telescopic flexible pipes. The top of the housing assembly 10 is provided with a plurality of pipe holes 50*a* for storing the dust collection pipes. The housing assembly 10 further includes a pipe hole cap 50*b* for closing the pipe holes 50*a*.

The above shows and describes fundamental principles, major characteristics and advantages of the present disclosure. Those skilled in the art should understand that the above embodiments are not intended to limit the present disclosure in any form, and any technical solution obtained based on equivalent replacements or equivalent transformations fall within the scope of protection of the present disclosure.

What is claimed is:

1. A garbage-can-type dust collector, comprising: a housing assembly, an inner barrel body for mounting or fixing a garbage bag, and a draught fan for driving airflow movement such that dust enters the garbage bag, wherein the inner barrel body is detachably mounted on the housing assembly, the inner barrel body is provided with an accommodating chamber, and the garbage bag arranged in the accommodating chamber divides the accommodating chamber into an upper chamber and a lower chamber; and the housing assembly and/or the inner barrel body is provided with a dust collection inlet allowing the dust to enter the garbage bag in the inner barrel body, an gas extraction hole for extracting gas in the garbage bag to form a negative pressure forcing the dust to be collected from the dust collection inlet into the garbage bag, and a wind chamber where gas is extracted by the draught fan to generate the negative pressure when the draught fan is in operation; the gas extraction hole is communicated to the wind chamber and the upper chamber; the inner barrel body is provided with a gas suction port for extracting air in the lower chamber when the draught fan is in operation; and the gas suction port communicates the wind chamber to the lower chambers;

wherein the garbage-can-type dust collector further comprises a seal-capping for sealing off the gas suction port, and the seal-capping is mounted on the inner barrel body.

2. The garbage-can-type dust collector according to claim 1, wherein the gas suction port is arranged at a bottom of the inner barrel body.

3. The garbage-can-type dust collector according to claim 2, wherein the gas suction port is arranged right above the draught fan.

4. The garbage-can-type dust collector according to claim 1, wherein the inner barrel body comprises an upper barrel hoop and a lower barrel body, the upper barrel hoop is detachably connected to the lower barrel body, the upper barrel hoop and the lower barrel body clamp the garbage bag, and the lower barrel body is provided with the gas suction port.

5. The garbage-can-type dust collector according to claim 4, wherein the garbage-can-type dust collector further comprises a handle allowing a user to grip to separate the inner barrel body from the housing assembly, and the handle is connected to the upper barrel hoop.

6. A garbage-can-type dust collector, comprising: a housing assembly, an inner barrel body for mounting or fixing a garbage bag, and a draught fan for driving airflow movement such that dust enters the garbage bag, wherein the inner barrel body is detachably mounted on the housing assembly, the inner barrel body is provided with an accommodating chamber, and the garbage bag arranged in the accommodating chamber divides the accommodating chamber into an upper chamber and a lower chamber; and the housing assembly and/or the inner barrel body is provided with a dust collection inlet allowing the dust to enter the garbage bag in the inner barrel body, an gas extraction hole for extracting gas in the garbage bag to form a negative pressure forcing the dust to be collected from the dust collection inlet into the garbage bag, and a wind chamber where gas is extracted by the draught fan to generate the negative pressure when the draught fan is in operation; the gas extraction hole is communicated to the wind chamber and the upper chamber; the inner barrel body is provided with a gas suction port for extracting air in the lower chamber when the draught fan is in operation; and the gas suction port communicates the wind chamber to the lower chamber;

wherein the inner barrel body comprises an upper barrel hoop and a lower barrel body, the upper barrel hoop is detachably connected to the lower barrel body, the upper barrel hoop and the lower barrel body clamp the garbage bag, and the lower barrel body is provided with the gas suction port;

wherein the housing assembly comprises a housing provided with a barrel chamber for accommodating the inner barrel body, a top cap for closing the barrel chamber, and a pipe mounting element for mounting a dust collection pipe, the top cap is movably connected to the housing, the pipe mounting element is fixed to the housing, the pipe mounting element is provided with a dust collection nozzle allowing gas to enter, the upper barrel hoop is provided with the dust collection inlet, and the dust collection inlet is communicated to the dust collection nozzle; and a side of the upper barrel hoop far away from the dust collection inlet is provided with a first guide diagonal rib for working in coordination with the housing assembly to limit a position of the inner barrel body with respect to the housing assembly such that an outer wall surface of the dust collection inlet fits into the pipe mounting element to provide good sealing.

7. The garbage-can-type dust collector according to claim 6, wherein the housing assembly further comprises a dust collection nozzle cap for closing the dust collection nozzle and a reset spring for resetting the dust collection nozzle cap; and the dust collection nozzle cap is rotatably connected to the pipe mounting element.

8. The garbage-can-type dust collector according to claim 6, wherein the housing comprises: a side housing surrounding the inner barrel body and a bottom base for supporting the inner barrel body; and the draught fan is mounted on the bottom base, the bottom base is provided with an exhaust port communicating to the wind chamber to allow gas to discharge and a gas inlet communicating to the wind chamber, and the gas inlet is aligned to the gas suction port.

9. A garbage-can-type dust collector, comprising: a housing assembly, an inner barrel body for mounting or fixing a garbage bag, and a draught fan for driving airflow movement such that dust enters the garbage bag, wherein the inner barrel body is detachably mounted on the housing assembly, the inner barrel body is provided with an accommodating chamber, and the garbage bag arranged in the accommodating chamber divides the accommodating chamber into an upper chamber and a lower chamber; and the housing assembly and/or the inner barrel body is provided with a dust collection inlet allowing the dust to enter the garbage bag in the inner barrel body, an gas extraction hole for extracting gas in the garbage bag to form a negative pressure forcing the dust to be collected from the dust collection inlet into the garbage bag, and a wind chamber where gas is extracted by the draught fan to generate the negative pressure when the draught fan is in operation; the gas extraction hole is communicated to the wind chamber and the upper chamber; the inner barrel body is provided with a gas suction port for extracting air in the lower chamber when the draught fan is in operation; and the gas suction port communicates the wind chamber to the lower chamber; wherein the inner barrel body comprises an upper barrel hoop and a lower barrel body, the upper barrel hoop is detachably connected to the lower barrel body, the upper barrel hoop and the lower barrel body clamp the garbage bag, and the lower barrel body is provided with the gas suction port;

wherein the upper barrel hoop is provided with the gas extraction hole, the housing assembly comprises a gas extraction pipe communicating the gas extraction hole to the wind chamber and a pipe joint for connecting the gas extraction pipe to the upper barrel hoop such that gas enters the wind chamber through the extraction pipe via the gas extraction hole, and the pipe joint is mounted at one end of the gas extraction pipe; and a side of the upper barrel hoop far away from the pipe joint is provided with a second guide diagonal rib for working in coordination with the housing assembly to limit a position of the inner barrel body with respect to the housing assembly such that the upper barrel hoop fits into the pipe joint to provide good sealing.

* * * * *